US006527204B2

(12) United States Patent
Heitzman

(10) Patent No.: US 6,527,204 B2
(45) **Date of Patent: *Mar. 4, 2003**

(54) SHOWER HEAD WITH PULSATION VARIABLE FLOW RATE

(76) Inventor: Charles J. Heitzman, 1330 Ala Moana Blvd., Honolulu, HI (US) 96813

( * ) Notice: Subject to any disclaimer, the term of this patent is extended or adjusted under 35 U.S.C. 154(b) by 0 days.

This patent is subject to a terminal disclaimer.

(21) Appl. No.: 09/910,547

(22) Filed: Jul. 23, 2001

(65) Prior Publication Data

US 2003/0015608 A1 Jan. 23, 2003

(51) Int. Cl.[7] ..... B05B 1/30

(52) U.S. Cl. ..... 239/569; 239/99; 239/225.1; 239/237; 239/380; 239/381; 239/581.1; 239/240; 239/548

(58) Field of Search ..... 239/99, 101, 225.1, 239/237, 240, 380, 381, 569, 581.1, 581.2, 548

(56) References Cited

U.S. PATENT DOCUMENTS 5,397,064 A * 3/1995 Heitzman ..... 239/99
5,518,181 A * 5/1996 Shames et al. ..... 239/381
5,577,664 A * 11/1996 Heitzman ..... 239/99
5,938,123 A * 8/1999 Heitzman ..... 239/380
6,126,091 A * 10/2000 Heitzman ..... 239/380

* cited by examiner

*Primary Examiner*—Robin O. Evans
(74) *Attorney, Agent, or Firm*—Jacox, Meckstroth & Jenkins

(57) ABSTRACT

A shower head includes a housing supporting a low speed rotary valve member driven by a high speed rotary turbine to produce a variable flow rate. The turbine also produces pulsations of water streams discharged from the housing and is shifted axially to produce continuous water streams. A manually actuated control valve and passages with pressure responsive flow control washers provide for selecting different ranges of variable flow or for bypassing the variable flow.

4 Claims, 1 Drawing Sheet

SHOWER HEAD WITH PULSATION VARIABLE FLOW RATE

BACKGROUND OF THE INVENTION

The present invention relates to a shower head with pulsation and a variable flow rate, as also disclosed in U.S. Pat. No. 5,577,664 which issued to Applicant and the disclosure of which is hereby incorporated by reference. In general, the shower head disclosed in the '664 patent provides the option of selecting, either separately or in combination, a discharge spray with or without pulsation, a variable flow rate and an infinitely variable spray pattern. The shower head of the present invention also provides a spray pattern with or without a variable flow rate and with or without pulsation, and further provides for a simplified and compact construction.

DESCRIPTION OF THE PREFERRED EMBODIMENT

Figure 1:
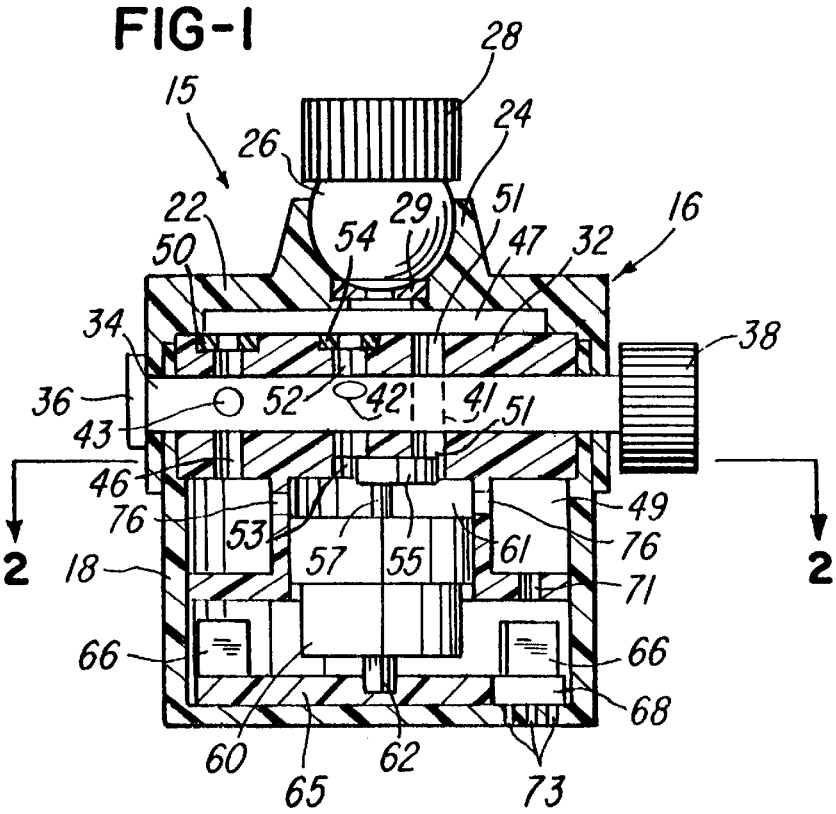
FIG. 1 is an axial section of a shower head constructed in accordance with the invention.
Figure 2:
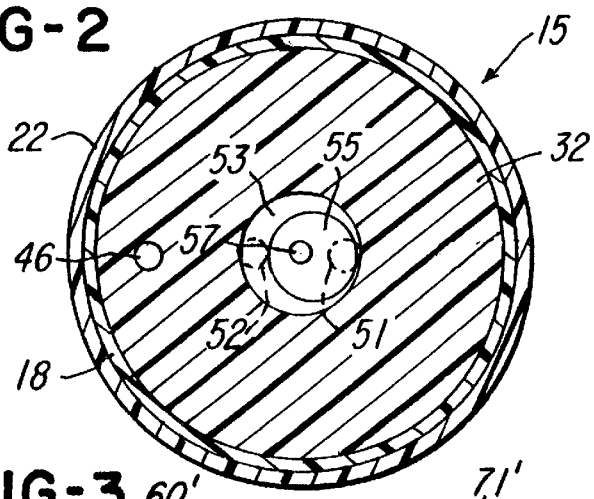
FIG. 2 is a radial section taken generally on the line 2—2 of FIG. 1.

The components of a shower head 15, as shown in FIG. 1, are preferably molded of a rigid plastics material. The components include a generally cylindrical housing 16 including a cup-shaped lower portion 18 and a cap-shaped upper portion 22. The upper portion 22 has an annular neck portion 24 for receiving a part-spherical ball 26 of a tubular fitting 28 to provide a universal swivel connection between the housing 16 and the fitting 28 which connects to a water supply line. A pressure compensating flow washer 29 provides a predetermined flow rate of about 3.5 gallons per minute (GPM).

The housing 16 encloses a cylindrical valve body 32 defining a cross bore which receives a cylindrical valve member 34. One end of the valve member 34 has an integral head 36, and a knurled knob 38 is secured onto the opposite end portion of the valve member 34. Cylindrical ports 41 and 42 extend diametrically through the center portion of the valve member 34, and a port 43 extend diametrically through an end portion of the valve member in a direction perpendicular to the port 41.

The valve body 32 has a port 46 which extends in an axial direction through the valve body and connects an inlet chamber 47 to an annular chamber 49. The port 43 is aligned with the port 46 when the valve member 34 is rotated 90° from the position shown in FIG. 1. A pressure compensating flow control washer 50 provides a flow rate of about 2.5 GPM through the port 46. The valve body 32 also has two ports 51 and 52 which selectively align with the ports 41 and 42 and connect the chamber 47 to a cylindrical chamber 53 within the center portion of the valve body 32. A pressure compensating flow control washer 54 provides a flow rate of about 2.5 GPM through the port 52. A circular valve member 55 is positioned within the chamber 52 and is eccentrically mounted on an output shaft 57 of a speed reducing drive or gearbox 60 seated within a chamber 61 of the valve body 32.

The speed reducer 60 has a square or non-circular input shaft 62 which is driven by a rotary turbine wheel 65 having circumferentially spaced and upwardly projecting blades 66 and an arcuate opening 68. Preferably, the speed reducer 60 provides a substantial reduction in speed from the input shaft 62 to the output shaft 57, for example, a reduction of 10 to 1. Thus if the turbine wheel 65 rotates at 600 rpm, the output shaft 57 and the eccentric valve member 55 rotate at 10 rpm or one revolution every six seconds. The turbine wheel 65 is driven by water jets directed by a set of three circumferentially spaced drive ports 71 which direct pressurized water within the chamber 49 at an angle towards the blades 66 on the impeller 65. The bottom wall of the lower housing portion 18 has circumferentially spaced sets or groups of small orifices 73 which are opened and closed in response to rotation of the turbine wheel 65 in order to produce pulsation of the discharge streams of water through the orifices, in the same manner as disclosed in the above '664 patent.

As a result of the size and eccentric position of the rotating valve member 55, when water flows through the ports 51 and 41, the flow rate varies from a completely open port 51 to an almost closed position of the port 51 (FIG. 1) so that the flow rate through the ports varies between a high flow rate such as 3.5 GPM and a low flow rate such as 1.5 GPM. The water flowing past the rotary eccentric valve member 55 flows into the circular chamber 61 and outwardly through peripherally spaced ports 76 into the annular chamber 49. During the lowest flow rate of water past the rotary valve member 55, sufficient water flows into the chamber 49 to continue rotation of the turbine wheel 65 to maintain rotation of the turbine wheel and valve member 55 during the low flow portion of the cycle. When the knob 38 is rotated to close the port 51 and open the port 52, the flow rate through the port 52 will vary, for example, between 2.5 GPM and 1.0 GPM to provide an average flow rate of 1.75 GPM.

When it is desired to bypass the variable flow rate of water through the shower head 15, valve member 34 is rotated manually with the knob 38 until the ports 51 and 52 are closed and the port 46 is open to the flow of water through the port 43 within the valve member 34 to provide a maximum continuous flow rate of 2.5 GPM. Also, the flow rate through the port 46 may be manually adjusted or varied by rotating the knob 38 in order to select the desired flow rate of pulsating water streams from the orifices 73. While the valve member 55 continues to rotate within the chamber 53 in response to rotation of the turbine wheel 65, if the ports 51 and 52 are completely closed, there is no automatic cycling of the flow rate between high and low flow rates. By turning the knob 38 until the ports 46 and 51 or 52 are all partially open, the automatic variable flow rate may be infinitely changed to the selected variable flow rate desired.

Figure 3:
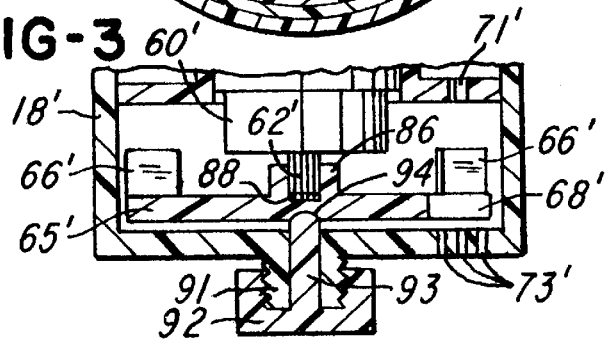
FIG. 3 is a fragmentary axial section showing a modification of the invention.

Referring to FIG. 3, a rotary turbine wheel 65' is constructed similar to the turbine wheel 65 and includes circumferentially spaced and upwardly projecting blades 66' and also an upwardly projecting hub 86 defining a square or spline cavity 88 for slidably receiving the input shaft 62' of the speed reducer 60'. The bottom wall of the lower housing portion 18' includes an externally threaded boss 91 which threadably receives a control knob 92 having an upwardly projecting center stud or pin 93 with a rounded upper end surface. The bottom surface of the rotary turbine wheel 65' has a center part-circular cavity 94 which receives the top end of the pin 93 to form a rotary bearing support.

When it is desired to provide a variable flow rate without pulsation, the control knob 92 is rotated so that the pin 93 lifts the turbine wheel 65' upwardly causing the rotor hub 86' to slide upwardly on the input shaft 62' of the speed reducer 60'. When the turbine wheel 65' is elevated, water flows around the turbine wheel, through the opening 68' and simultaneously through all of the orifices 73' so that continuous streams are discharged from the orifices while the turbine wheel 65' continues to rotate. In this mode, the rotating eccentric valve member 55 produces a variable flow rate of water through the ports 71' and a non-pulsating variable flow rate of water is discharged through all of the orifices 73'.

From the drawing and the above description, it is apparent that a shower head constructed in accordance with the present invention provides desirable features and advantages. As one feature, the shower head 15 not only provides for pulsation of the discharge spray streams, but also provides for automatically varying the flow rate with or without pulsation. The variable flow rate is desirable for providing a different shower sensation with maximum intensity while also saving water since the average of the variable flow rate can be made not to exceed the commonly accepted code requirement of 2.5 gallons per minute by cycling between 3.5 GPM and 1.5 GPM. If a further water saving feature is desired, the port 42 provides for cycling at a lower average flow rate such as 1.75 GPM.

It is also apparent that the rotary turbine wheel 65 not only functions to produce pulsation of the discharge water streams from the spray orifices 73, but also functions to drive the eccentric valve member 55 at a substantially lower speed through the gear or speed reducing unit 60. The control device on knob 92 also provides for variably adjusting the intensity of the pulsation by adjusting the position of the turbine wheel 65' above the bottom wall of the housing portion 18'. In addition, the shower head has a minimum number of molded plastic components and is compact in size.

While the forms of shower head herein described constitute preferred embodiments of the invention, it is to be understood that the invention is not limited to these precise forms of shower head, and that changes may be made therein without departing from the scope and spirit of the invention as defined in the appended claims.

What is claimed is:

1. A shower head assembly comprising a housing having a passage for directing water into said housing, said housing supporting a flat orifice wall defining a plurality of orifices for directing water from said housing in water streams forming a spray, a rotary turbine supported for rotation on an axis within said housing and driven by water flowing through said housing, said rotary turbine including a radially extending turbine wall positioned adjacent said orifice wall and said orifices and defining an opening for pulsating the water streams discharged from said orifices, and a manually actuated control for shifting said rotary turbine axially relative to said orifice wall while said turbine is rotating to space said turbine wall from said orifice wall and said orifices for producing continuous water streams from said orifices.

2. A shower head assembly as defined in claim 1 and including a first port within said housing and having a first pressure responsive flow control washer for producing a first maximum flow rate into said housing, a second port having a second pressure responsive flow control washer for producing a second maximum flow rate through said housing lower than said first rate, and a manually actuated control valve for directing water selectively through said first port and said second port.

3. A shower head assembly comprising a housing defining a passage for directing water into said housing, a rotary turbine supported for rotation on an axis within said housing and driven by water flowing through said housing, a radially extending flat orifice wall defining a plurality of orifices for directing water from said housing in water streams forming a spray, said rotary turbine including a radially extending flat turbine wall positioned adjacent said orifice wall and said orifices for pulsating the water streams in response to rotation of said turbine, and a manually actuated control for relatively shifting said rotary turbine axially between a first position where said turbine wall produces pulsations of said water streams and a second position with said turbine wall spaced axially from said orifice wall for producing continuous water streams from said orifices while said turbine is rotating.

4. A shower head assembly comprising a housing having a passage for directing water into said housing, said housing supporting an orifice wall defining a plurality of orifices for directing water from said housing in water streams forming a spray, a rotary turbine supported for rotation on an axis within said housing and driven by water flowing through said housing, said rotary turbine including a turbine wall positioned adjacent said orifice wall and said orifices and defining an opening for pulsating the water streams discharged from said orifices, a first port within said housing and having a first pressure responsive flow control washer with a first flow rate for producing a first maximum flow rate into said housing, a second port having a second pressure responsive flow control washer with a second flow rate lower than said flow rate of said first pressure responsive flow control washer for producing a second maximum flow rate through said housing lower than said first rate, and a manually actuated control valve member for directing water selectively through said first port and said second port.

* * * * *